United States Patent [19]

Heinzer et al.

[11] 4,001,544

[45] Jan. 4, 1977

[54] APPARATUS FOR FIXING ELECTROPHOTOGRAPHIC IMAGES

[75] Inventors: Paul Heinzer; Helmut Wulz, both of Zurich, Switzerland

[73] Assignee: WIFO Wissenschaftliches Forschungsinstitut A.G., Zurich, Switzerland

[22] Filed: Nov. 8, 1974

[21] Appl. No.: 522,127

[30] Foreign Application Priority Data

Nov. 16, 1973 Switzerland ..... 16142/73
Oct. 4, 1974 Switzerland ..... 13384/74

[52] U.S. Cl. ..... 219/216; 100/93 RP; 219/388; 219/469; 432/60; 432/228

[51] Int. Cl.[2] ..... H05B 1/00

[58] Field of Search ..... 219/216, 388, 469–471; 432/60, 228; 100/93 RP; 355/9, 3

[56] References Cited

UNITED STATES PATENTS 3,359,404 12/1967 Limberger ..... 219/216
3,612,820 10/1971 Punnett ..... 219/470 X

*Primary Examiner*—C. L. Albritton
*Attorney, Agent, or Firm*—Stewart and Kolasch, Ltd.

[57] ABSTRACT

Apparatus for fixing electrophotographic images carrying toner powder and comprising an upper heated fixing roller and a lower driven counter roller cooperating with the fixing roller to form a nip for the passage of image bearing sheets to be fixed, the fixing roller having a resilient tubular shell of metal or other material of high thermal conductivity.

22 Claims, 6 Drawing Figures

APPARATUS FOR FIXING ELECTROPHOTOGRAPHIC IMAGES

This invention relates to apparatus for fixing electrophotographic images carrying toner powder of the kind comprising an upper heated fixing roller and a cooperating lower counter roller between which the image bearing sheets are passed for fixation.

In a known apparatus of this kind both rollers have rigid tubular shells, the shell of the counter roller having a rubber covering. The fixing roller has an internal heater and the rollers are pressed together in operation so that the images passed between them are fixed by the combined action of pressure and the heat provided by the fixing roller.

The entire apparatus must attain a sufficiently high temperature before fixing of the images can commence. Since the known apparatus just described is relatively heavy a substantial time, of the order of some minutes, is required for heating up of the apparatus after a pause in operation of the associated photocopying machine, e.g. over night.

A further disadvantage of the known apparatus is that the rollers must be pressed firmly together to attain sufficient heat transfer from the fixing roller to the image bearing sheets and to enlarge the contact area by deformation of the rubber covering of the counter roller. The relatively high pressure permits no lateral movement of the sheets passing between the rolls and there is accordingly the risk of folds developing in the sheets.

With a view to overcoming these disadvantages the invention provides apparatus for fixing electrophotographic images carrying toner powder and comprising an upper heated fixing roller and a lower driven counter roller cooperating with the fixing roller to form a nip for the passage of image bearing sheets to be fixed, the fixing roller having a resilient tubular shell of metal or other material of high thermal conductivity.

Figure 1:
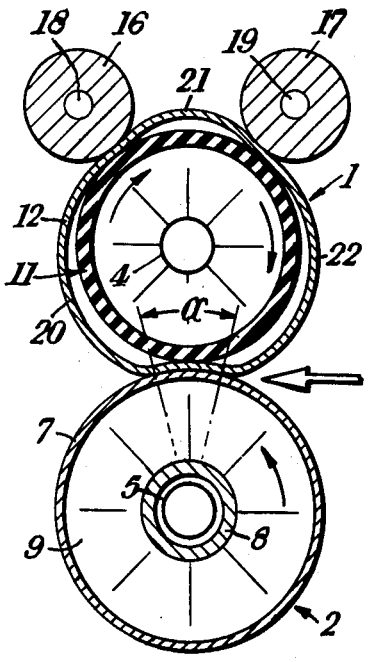
Figure 2:
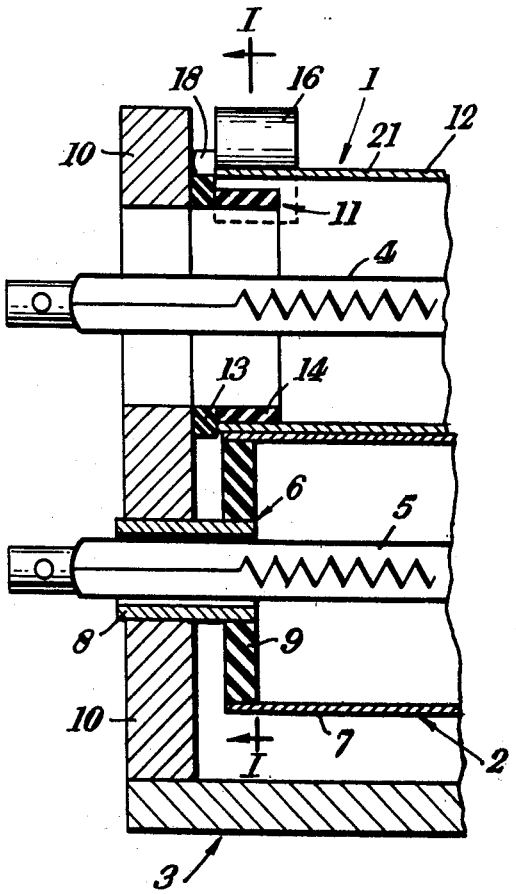
Figure 3:
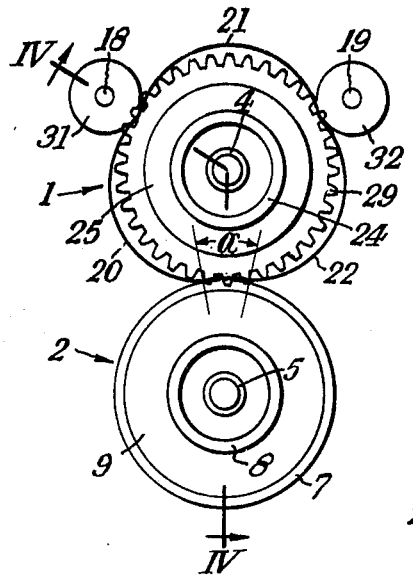
Figure 4:
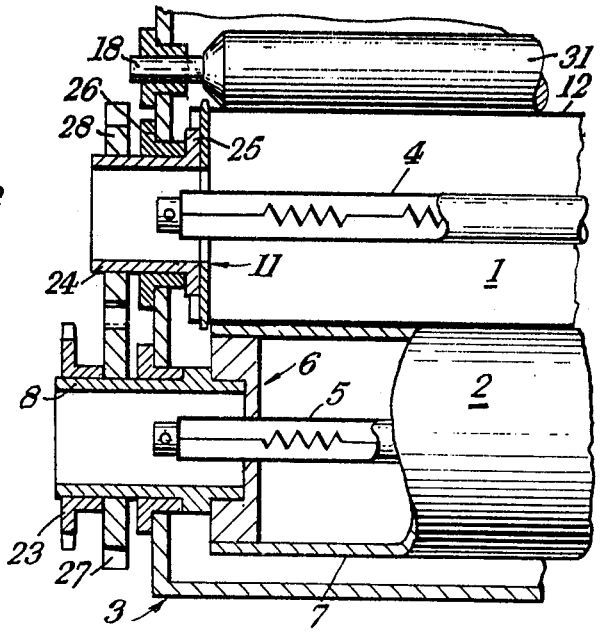
Figure 5:
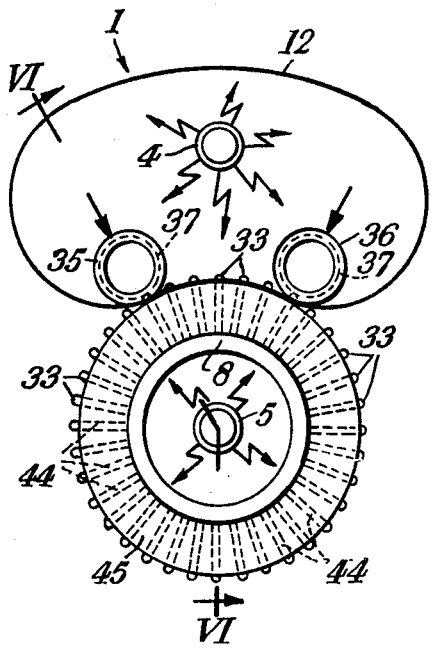
Figure 6:
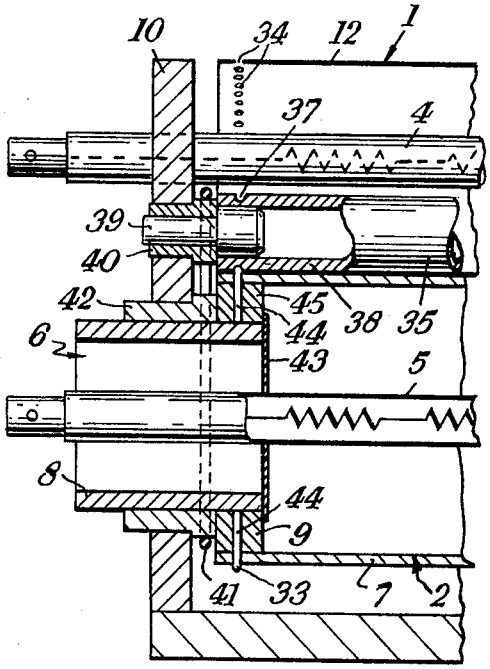

Three embodiments of fixing apparatus according to the invention are illustrated, by way of example, in the accompanying drawings, in which:

FIG. 1 is a schematic vertical section, on the line I—I in FIG. 2 showing the first embodiment, FIG. 2 is a longitudinal section showing one end only of the apparatus of FIG. 1, FIG. 3 is a diagrammatic end elevation showing parts only of the second embodiment, FIG. 4 is a section on the line IV—IV in FIG. 3 showing one end only of the apparatus, FIG. 5 is an end elevation, similar to that in FIG. 3, showing parts only of the third embodiment, and FIG. 6 is a section on the line VI—VI in FIG. 5, again showing one end only of the apparatus.

The apparatus illustrated in FIGS. 1 and 2 includes a fixing roller 1 and a counter roller 2, rotatably mounted in a housing 3 and to the nip of which the material to be fixed is fed as indicated by the arrow in FIG. 1. This material consists of sheets of electrophotographic material which have been subjected to imagewise exposure in an electrophotographic copying machine followed by application of toner powder.

The rollers 1, 2 are hollow and contain respective internal heaters 4, 5 which are provided with electric energy from a source (not shown) and generate the heat necessary for fixation of the images. In many instances it is sufficient to provide the fixing roller only with a heater.

The counter roller 2 has two hollow trunnions 6, one only of which is illustrated and these trunnions are joined by the tubular shell 7 of the roller. Each trunnion 6 consists of a tubular portion 8 journalled in a side wall 10 of the housing 3 and a flange 9 attached at its periphery to the shell 7. The tubular portion 8 of one trunnion projects from the housing 3 and is driven by a driving motor, not shown.

The fixing roller 1 also has two hollow trunnions 11, one only of which is shown, and a resilient metal shell 12, which may have a thickness of 60 – 70 $\mu$. Each trunnion consists of an outer portion 13, which abuts against the side wall 10 and a tubular spigot portion 14, having an external diameter less than the internal diameter of the shell 12, which is attached to the outer portion 13 and is disposed within the end of the shell 12 and overlies the corresponding end portion of the shell 7 of the counter roller 2.

Each trunnion 11 is urged into contact with the shell 12 by a pair of pressure rollers 16, 17 journalled on projections 18, 19 from the adjacent end wall 10. Each end of the resilient shell 12 is accordingly deformed from a cylindrical configuration to the configuration shown in FIG. 1 so that it contacts the trunnion 11 only at the zones of contact of the shell 12 with the counter roller 2 and with the rollers 16, 17 and bulges away from the trunnions as indicated at 20, 21, 22 in the areas between these three contact zones. The shell 12 and the trunnions 11 thus receive a friction drive from the counter roller 2. Since the resilient, tubular shell 12 of the fixing roller 1 bears for its full length against the rigid shell 7 of the counter roller 2 the distortion of the shell 12 extends for its full length.

The zone of contact between the shells 12 and 7 extends over a substantial angular range $\alpha$ and the images to be fixed remain in contact with the hot, resilient shell 12 of the fixing roller for a period determined by the speed of rotation of the rollers 1, 2 and the angle $\alpha$.

The angle $\alpha$ can be varied by shifting the position of the rollers 16, 17 with respect to the periphery of the trunnion 11, by alteration of the diameter of the shell 12 of the fixing roller, by alteration of the diameter of the counter roller 2 or by a combination of these expedients. Increase in the angle $\alpha$ increases the speed at which the images to be fixed can be passed through the apparatus.

The time required to heat the fixing apparatus to operating temperature is very short, e.g. a few seconds, because the lightweight fixing roller 1 can rapidly assume the temperature requisite for fixing the toner image.

Owing to the resilience of the shell 12, the rigid shell 7 of the counter roller 2 can be relatively thin. The counter roller 2 therefore need not be heavy and it therefore does not impose any substantial delay upon resumption of fixing after the associated copying machine has been at a standstill.

When the counter roller 2 is not heated, its shell 7 may consist of material of low thermal conductivity.

A further advantage is that the pressure exerted on the image bearing sheets as they pass between the rollers 1, 2 is small so that no folds are imposed on the sheets. If desired, the shell 7 of the counter roller 2 may be resilient but its two trunnions 6 should then be synchronously driven.

At least one of the rolls 1, 2 can have an anti-stick surface layer of fluorinated hydrocarbon, silicone rubber or silicone oil to facilitate release of the sheets from the rollers after fixing.

The thickness of the shells of the rollers 1, 2 must be sufficient to provide sufficient strength but should not be so large as to impede heat transfer through the shell. When the shells are made of one of the metals copper, nickel, cobalt or chromium, or of alloys containing these metals, their thickness may be between 20 and 200 $\mu$, and preferably 50–100 $\mu$.

One or more thermal sensors may be provided for controlling the heating up of the apparatus and its temperature of operation.

The rollers 1 and 2 can remain in contact during long periods of standstill without deformation. This is not so in the case of the known apparatus with a rubber covered roller, in which the rollers must be separated when a long standstill period is expected.

The deformable shell 12 of the apparatus illustrated imposes an even pressure on the image bearing sheets and its deformation facilitates release of the sheets from it.

A saving in energy can be attained by making the trunnions of the heated rollers of thermally insulating material.

The counter roller 2 of the embodiment shown in FIGS. 3 and 4 is generally similar to that shown in FIGS. 1 and 2, but the tubular portion 8 of its trunnion 6 is shown as carrying a sprocket 23 which is chain-driven from a motor (not shown). The trunnions 11 of the fixing roller 1 are, however, of different construction. Each consists of a tubular portion 24, having a flange 25 abutting against a bearing sleeve 26 in the side wall 10 of the housing 3 and extending into a portion of the end of the resilient shell 12 which projects beyond the end of the counter roller 2.

To ensure synchronous rotation of the rollers 1, 2 the tubular portions 8 and 24 of the trunnions at one end of the apparatus carry meshing gears 27 and 28 respectively and the flange 25 of this trunnion carries a gear 29, the teeth of which engage perforations, not shown, in the resilient shell 12.

The pressure rollers 31, 32 in this case extend for the full length of the fixing roller 1.

In the embodiment shown in FIGS. 5 and 6, the driven counter roller 2 is generally similar to those in the other embodiments. The flanges 9 of its trunnions 6 have teeth 33, constituted in this case by the ends of pins 44 disposed at uniform peripheral spacing between discs 45 constituting the flange, and engaging perforations 34 in the resilient shell 12 of the fixing roller 1 to ensure synchronous rotation of the rollers 1, 2.

The fixing roller 1 consists solely of the shell 12 and has no trunnions. The pressure rollers 35, 36 are disposed within the shell 12 on opposite sides of its zone of contact with the shell 7 and deform it as shown in FIG. 5. Each pressure roller has a tubular shell 38, having in its ends peripheral grooves 37 to accommodate the teeth 33 and trunnions 39 which are rotatable in bearing sleeves 40, which are mounted with radial play in holes in the side walls 10 of the housing but restrained from rotation. Springs 41 encircling the bearing sleeves 40 and bearing sleeves 42 in which the trunnions of the counter roller 2 are journalled urge the pressure rollers 35, 36 and the shell 12 against the counter roller 2.

To minimise heat losses, the flanges 9 of the trunnions of the counter roller 2 carry on their inner faces reflectors 43 for reflecting towards the shell 7 the heat radiated from the heater 5.

What we claim as our invention and desire to secure by letters patent is:

1. An apparatus for fixing electrophotographic images carrying toner powder imposed on image-bearing sheets which comprises, a housing, a fixing roller rotatably mounted in said housing, a counter roller rotatably mounted in said housing, means for rotating the counter roller and the fixing roller associated therewith, said fixing and counter rollers being disposed substantially parallel with respect to each other and defining therebetween a nip for the passage of said sheets between said rollers, said rollers having tubular shells which remain in contact with said sheets throughout their passage through said nip and the shell of said fixing roller being made of a thin, resiliently deformable material of high thermal conductivity, a heating means disposed within the fixing roller and pressure means for urging the shell of said fixing roller towards the counter roller and operative to deform said shell to provide, in the absence of a sheet in said nip, a zone of contact between the shells of said rollers which extends over a substantial angular range.

2. Apparatus according to claim 1, in which the fixing roller includes hollow trunnions having spigot portions fitted into the ends of the shell and overlapping the counter roller and having an external diameter less then the internal diameter of the shell.

3. Apparatus according to claim 2, in which the trunnions have outer portions, external to the spigot portions, against which the ends of the shell abut.

4. The apparatus according to claim 1, in which said pressure means are pressure rollers which press the ends of the shell of the fixing roller against its trunnions.

5. Apparatus according to claim 4, in which the pressure rollers are disposed external to the fixing roller and are provided in pairs at opposite ends thereof.

6. The apparatus according to claim 1, in which said pressure means are pressure rollers which are disposed external to the fixing roller and extend for the full length thereof.

7. Apparatus according to claim 1, which includes a pair of pressure rollers disposed within the fixing roller at opposite sides of the zone of contact of its shell with the counter roller.

8. Apparatus according to claim 1, in which the counter roller has a rigid tubular shell and hollow end trunnions.

9. Apparatus according to claim 1, in which the counter roller contains an internal heater.

10. Apparatus according to claim 1 in which, to ensure synchronous rotation of the fixing roller and the counter roller, the tubular shell of the fixing roller has perforations engaged by teeth on a member driven by the counter roller.

11. Apparatus according to claim 10, in which the ends of the fixing roller carry hollow trunnions, one of which is geared to the counter roller and carries the teeth.

12. Apparatus according to claim 10, in which the counter roller has end trunnions carrying the teeth.

13. Apparatus according to claim 7, in which the pressure rollers are journalled with radial play and which includes a spring urging the pressure rollers into contact with the shell of the fixing rollers.

14. Apparatus according to claim 9, in which the counter roller has end trunnions carrying reflectors at their inner ends for reflecting towards its shell the heat radiated from its internal heater.

15. The apparatus according to claim 1, wherein the shell of said fixing roller is composed of a metal.

16. The apparatus of claim 15, wherein said shell has a thickness of 20 to 200 $\mu$.

17. The apparatus of claim 1, wherein the shell of the fixing roller is in frictional engagement with the shell of the counter roller.

18. The apparatus of claim 1, wherein the shell of the counter roller is resilient.

19. The apparatus of claim 1, wherein at least one of said rollers is provided with an anti-stick surface layer of a material selected from the group consisting of a fluorinated hydrocarbon, a silicone rubber and a silicone oil.

20. The apparatus of claim 15, wherein the metal is selected from the group consisting of copper, nickel, cobalt and chromium.

21. The apparatus of claim 20, wherein the shell of the counter roller is a resilient metal selected from the group consisting of copper, nickel, cobalt and chromium.

22. The apparatus of claim 1, wherein the fixing roller and the counter roller are provided with gear means which are in engaging relationship with each other.

* * * * *